US009531089B2

(12) United States Patent
Okuhira

(10) Patent No.: US 9,531,089 B2
(45) Date of Patent: Dec. 27, 2016

(54) TERMINAL CONNECTION STRUCTURE

(71) Applicant: SUMITOMO WIRING SYSTEMS, LTD., Yokkaichi, Mie (JP)

(72) Inventor: Yusuke Okuhira, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 14/751,837

(22) Filed: Jun. 26, 2015

(65) Prior Publication Data

US 2016/0006142 A1 Jan. 7, 2016

(30) Foreign Application Priority Data

Jul. 4, 2014 (JP) ..... 2014-139053

(51) Int. Cl.

| | |
|---|---|
| ***H01R 4/34*** | (2006.01) |
| ***H01R 4/64*** | (2006.01) |
| ***H01R 4/18*** | (2006.01) |
| *H01R 11/12* | (2006.01) |

(52) U.S. Cl.

CPC *H01R 4/34* (2013.01); *H01R 4/18* (2013.01); *H01R 4/184* (2013.01); *H01R 11/12* (2013.01)

(58) Field of Classification Search

CPC ..... H01R 4/34; H01R 4/64; H01R 4/36; H01R 11/12

See application file for complete search history.

(56) References Cited

U.S. PATENT DOCUMENTS

| | | | | |
|---|---|---|---|---|
| 4,106,843 | A * | 8/1978 | Salzer | H01R 4/302 439/801 |
| 4,145,107 | A * | 3/1979 | De Haitre | H01R 4/34 439/801 |
| 5,531,616 | A * | 7/1996 | Forestello | F21S 2/00 439/611 |
| 6,683,251 | B1 * | 1/2004 | Brant | H01R 4/34 174/138 G |
| 6,939,149 | B2 * | 9/2005 | Goodsell | H01R 4/30 174/51 |
| 8,192,238 | B2 * | 6/2012 | Majewski | H01R 4/34 439/801 |

FOREIGN PATENT DOCUMENTS

| | | |
|---|---|---|
| JP | 2001-231131 A | 8/2001 |
| JP | 2011-223693 A | 11/2011 |

* cited by examiner

*Primary Examiner* — Gary Paumen
(74) *Attorney, Agent, or Firm* — Oliff PLC

(57) ABSTRACT

A terminal connection structure is proposed in which a bolt tightening terminal is set on a terminal mounting portion and is fastened with a connecting bolt that is tightened to a nut of the terminal mounting portion. The terminal mounting portion is provided with a displacement limiting portion. If the bolt tightening terminal, set on a terminal mounting portion, is disposed in a proper mounting position in which a bolt insertion hole and a threaded hole are aligned on the same center axis, the bolt tightening terminal is adapted not to interfere with the displacement limiting portion. If the bolt tightening terminal is displaced from the proper mounting position, the bolt tightening terminal is adapted to interfere with the displacement limiting portion to limit the displacement from the proper mounting position.

9 Claims, 8 Drawing Sheets

TERMINAL CONNECTION STRUCTURE

CROSS-REFERENCE TO RELATED APPLICATIONS

This application claims priority to Japanese Patent Appl. No. 2014-139053 filed on Jul. 4, 2014, the disclosure of which is incorporated herein by reference in its entirety.

TECHNICAL FIELD

Embodiments of the present application relate to a terminal connection structure for fastening a bolt fastening terminal provided at an end of an electrical wire to a terminal mounting portion provided on an electric circuit with a bolt.

BACKGROUND

Conventionally, electrical circuits, such as electrical connection boxes and fusible links, for use in automotive electrical equipment have been provided with a terminal mounting portion on which conduction members, such as bus bars, that constitute part of the electrical circuit are mounted. Such a conventional electrical circuit employs a terminal connection structure in which the electric circuit is brought into conduction with an electrical wire by fastening to the terminal mounting portion a bolt tightening terminal provided at an end of an electrical wire with a bolt. For example, JP 2001-231131A discloses a structure in which a stud bolt is erected in advance on the terminal mounting portion on which a bus bar is provided. According to this structure, the stud bolt is passed through the bolt insertion hole in the bolt tightening terminal at one end of an electrical wire, the bolt tightening terminal is then mounted on the terminal mounting portion with the bolt tightening terminal engaging the stud bolt, and subsequently a nut is tightened on the stud bolt.

In recent years, due to the increasing number of electrical components mounted on vehicles and demands for downsizing vehicles, the onboard space for electrical circuitry is increasingly limited. Accordingly, it is sometimes difficult to dispose a stud bolt with a large projection as in JP 2001-231131A. To address such a situation, for example, JP 2011-223693A discloses a structure in which a nut is disposed in advance in the terminal mounting portion. According to this structure, a bolt tightening terminal is mounted on the terminal mounting portion with the bolt insertion hole of the bolt tightening terminal aligned with the threaded hole of the nut, and a connecting bolt, generally smaller than a stud bolt, is passed through the bolt insertion hole and then tightened to the threaded hole of the nut.

In the terminal connection structure disclosed in JP 2011-223693A, before the connecting bolt is tightened to the nut, the bolt tightening terminal of the electrical wire terminal is simply set on the terminal mounting portion without being secured. According to this structure, therefore, the bolt tightening terminal is more likely to fall off the terminal mounting portion compared with the bolt tightening terminal of the terminal connection structure disclosed in JP 2001-231131A in which a stud bolt is engaged with a bolt tightening terminal. Additionally, this structure has the inherent problem that the bolt tightening terminal is easily displaced from the proper mounting position in which the bolt insertion hole of the bolt tightening terminal and the threaded hole of the nut are aligned with each other. This may adversely affect the efficiency with which the bolt tightening terminal is fastened to the terminal mounting portion.

One conceivable solution might be to employ a structure in which the bolt tightening terminal is fitted into the terminal mounting portion before the bolt tightening terminal is fastened with a connecting bolt as this can maintain the alignment between the bolt tightening terminal and the terminal mounting portion. However, this would require a large force to mount the bolt tightening terminal in the terminal mounting portion, again possibly affecting the work efficiency.

JP 2001-231131A and JP 2011-223693A are examples of related art.

SUMMARY OF THE INVENTION

Embodiments of the present application have been made in the light of the above-described circumstances and provides, as a solution to the problem, a novel terminal connection structure that allows a bolt tightening terminal to be easily set on a terminal mounting portion in which a nut is disposed and also allows the bolt tightening terminal to be maintained in the proper position on the terminal mounting portion prior to the fastening of the bolt tightening terminal to the terminal mounting portion.

Various aspects of the embodiments of the present application solve the above-identified problem will be described below. It should be noted that the components employed in the various modes may be used in any possible combination.

The first aspect of an embodiment of the present application provides a terminal connection structure comprising a terminal mounting portion provided on an electric circuit, a nut with a threaded hole formed therein and that is disposed on the terminal mounting portion, a bolt tightening terminal with a bolt insertion hole formed therein and that is provided at an electrical wire end, and a connection bolt, wherein the bolt tightening terminal is set on the terminal mounting portion and is fastened to the terminal mounting portion by passing the connection bolt through the bolt insertion hole of the bolt tightening terminal and tightening the connection bolt to the threaded hole of the nut: wherein the terminal mounting portion is provided with a displacement limiting portion; wherein the bolt tightening terminal is configured such that, when the bolt tightening terminal, set on the terminal mounting portion, is disposed in a proper mounting position in which the bolt insertion hole and the threaded hole are aligned with each other on the same center axis (i.e. coaxially), the bolt tightening terminal does not to interfere with the displacement limiting portion; and wherein the bolt tightening terminal is configured such that, if the bolt tightening terminal, set on the terminal mounting portion, is displaced from the proper mounting position, the bolt tightening terminal interferes with the displacement limiting portion, limiting the displacement of the bolt tightening terminal from the proper mounting position.

According to this aspect, if the bolt tightening terminal is disposed in the proper mounting position on the terminal mounting portion, the displacement limiting portions do not interfere with the bolt tightening terminal. Accordingly, the provision of the displacement limiting portions permits the bolt tightening terminal to be easily set on the terminal mounting portion without requiring extra effort to mount the bolt tightening terminal on the terminal mounting portion.

Furthermore, if the bolt tightening terminal is displaced from the proper mounting position on the terminal mounting portion, the displacement limiting portions interfere with the bolt tightening terminal to limit the displacement thereof. Accordingly, this aspect of the invention prevents the misalignment between the threaded hole of the nut and the bolt insertion hole of the bolt tightening terminal and also prevents the bolt tightening terminal from dropping off the terminal mounting portion. As a result, although the nut is disposed in the terminal mounting portion in this structure, the bolt tightening terminal can be maintained in place on the terminal mounting portion.

The second aspect of an embodiment of the present application is directed to a terminal connection structure according to the first aspect, wherein the bolt tightening terminal includes a connecting plate portion having the bolt insertion hole provided therein, the connecting plate portion being set on the terminal mounting portion, a crimp portion crimped to the electrical wire end, and a link portion that links the connecting plate portion and the crimp portion, and the width dimension of the part of the link portion facing the connecting plate portion is made larger than the width dimension of the part of the link portion facing the crimp portion, and wherein the terminal mounting portion includes a pair of displacement limiting projections located on both widthwise sides of the link portion, the dimension of separation between the pair of displacement limiting projections is smaller than the width dimension of the part of the link portion facing the connecting plate portion and is larger than the width dimension of the part of the link portion facing the crimp portion, and the pair of displacement limiting projections constitute the displacement limiting portion.

According to this aspect, as the dimension of separation between the pair of displacement limiting projections is made smaller than the width dimension of the part of the link portion facing the connecting plate portion, tensile force is applied to the electrical wire, and when the bolt tightening terminal is displaced in the direction in which the bolt tightening terminal would otherwise come off the terminal mounting portion, the part of the link portion facing the connecting plate portion abuts against and interferes with the pair of displacement limiting projections. This prevents the bolt tightening terminal from coming off the bolt mounting portion while limiting the amount of displacement of the bolt tightening terminal from the proper mounting position.

Furthermore, as both widthwise sides of the link portion abut against and interfere with the pair of displacement limiting projections, the bolt tightening terminal avoids being tilted by the reaction force generated upon abutment, thus holding the connecting plate portion in a predetermined orientation in which the connecting plate portion is stably set on the terminal mounting portion. In addition, the effect of limiting displacement due to the abutment between the link portion and the pair of displacement limiting projections is advantageously exerted whether the connecting plate portion of the bolt tightening terminal is slidingly displaced toward the crimp portion with respect to the terminal mounting portion or is tiltingly and disengageably displaced with respect to the terminal mounting portion.

Moreover, the dimension of separation between the pair of displacement limiting projections is made larger than the width dimension of the part of the link portion facing the crimp portion. Accordingly, when the bolt tightening terminal is set in the proper mounting position on the terminal mounting portion, the pair of displacement limiting projections does not interfere with the link portion of the bolt tightening terminal, thus eliminating the need for exerting extra force for assembly.

The third aspect of an embodiments of the present application is directed to a terminal connection structure according to the second aspect, wherein the terminal mounting portion is provided with a pair of terminal rotation stopper projections on both widthwise sides of the link portion, and the pair of displacement limiting projections is integrally provided on opposing inner surfaces of the pair of terminal rotation stopper projections.

According to this aspect, a pair of terminal rotation stopper projections is provided on the terminal mounting portion in order to prevent the rotation of the bolt tightening terminal during bolt tightening. The terminal rotation stopper projections facilitate provision of the pair of displacement limiting projections, which constitute the pair of displacement limiting portions, while ensuring a high degree of durability for the displacement limiting portions. Specifically, by adjusting the amount of projection of the displacement limiting projections from the opposing inward surfaces of the terminal rotation stopper projections according to the geometry of the bolt tightening terminal, it is possible to advantageously configure the displacement limiting projections to suit the particular geometry of the bolt tightening terminal.

According to an embodiment of the present application, if the bolt tightening terminal is set in the proper mounting position on the terminal mounting portion, the bolt tightening terminal does not interfere with the displacement limiting portion provided on the terminal mounting portion. In this way, the bolt tightening terminal can be easily set on the bolt tightening terminal without requiring extra force. On the other hand, if the bolt tightening terminal is displaced from the proper mounting position on the terminal mounting portion, the bolt tightening terminal interferes with the displacement limiting portions to limit the displacement of the bolt tightening terminal. Accordingly, this aspect of the present application prevents the bolt tightening terminal from dropping off the terminal mounting portion and also prevents the displacement of the threaded hole of the nut from the bolt insertion hole of the bolt tightening terminal.

DETAIL DESCRIPTION

Embodiments of the present application will be described hereinafter with specific reference to the attached drawings.

Figure 1:
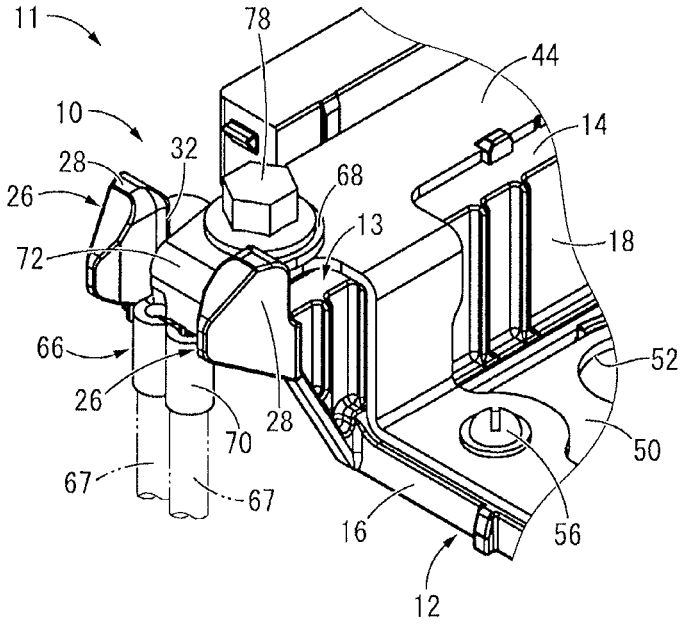
FIG. 1 is a perspective view showing of the relevant portion of a fusible link that includes a terminal connection structure according to a first embodiment of the present application.
Figure 2:
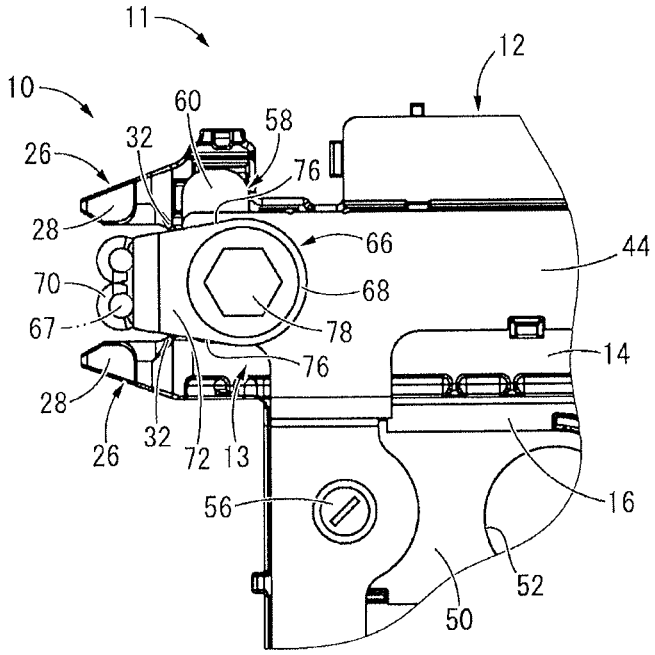
FIG. 2 is a plan view of the relevant portion of the fusible link shown in FIG. 1.
Figure 3:
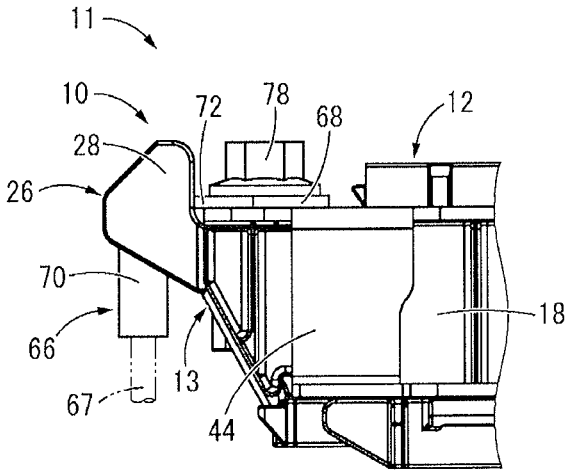
FIG. 3 is a front view of the relevant portion of the fusible link shown in FIG. 1.

FIGS. 1-3 show a part of an electric circuit, such as a fusible link 11, provided with a terminal connection structure 10, representing a first embodiment of the present application. The fusible link 11 is to be directly attached to a battery post of an automotive battery and has a structure in which conduction members, such as bus bars 44 and 50 (which will be described in detail below), and other components are mounted on a main case body 12 can be, in some embodiments made of a synthetic resin. Although omitted from the drawings, the fusible link 11 includes a fuse adapted to be blown by an over-current, thus being capable of preventing overheating of the electrical circuitry connected downstream of the fusible link 11 (e.g., wire harnesses). In the following description, unless otherwise specified, the term "upward/downward direction" as used herein refers to the upward/downward direction as seen in FIG. 3, the term "width direction" as used herein refers to the upward/downward direction as seen in FIG. 2, and the term "longitudinal direction" as used herein refers to the right/left direction as seen in FIG. 2.

Figure 5:
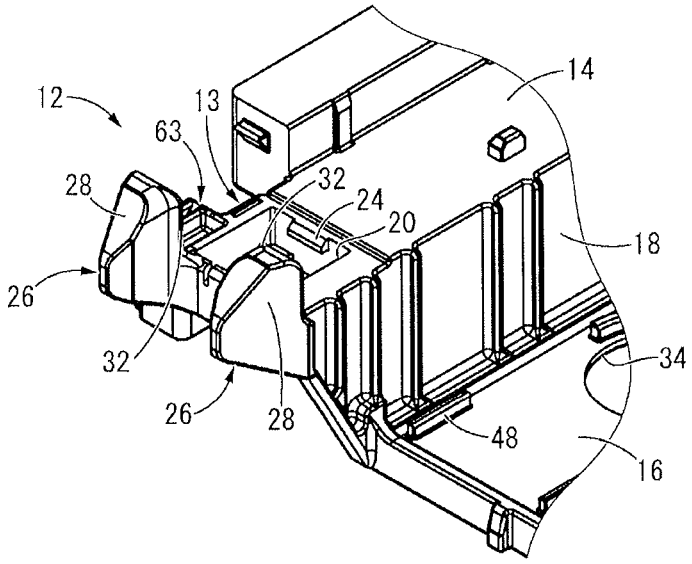
FIG. 5 is a perspective view of the relevant portion of the terminal mounting portion of the fusible link shown in FIG. 1.
Figure 6:
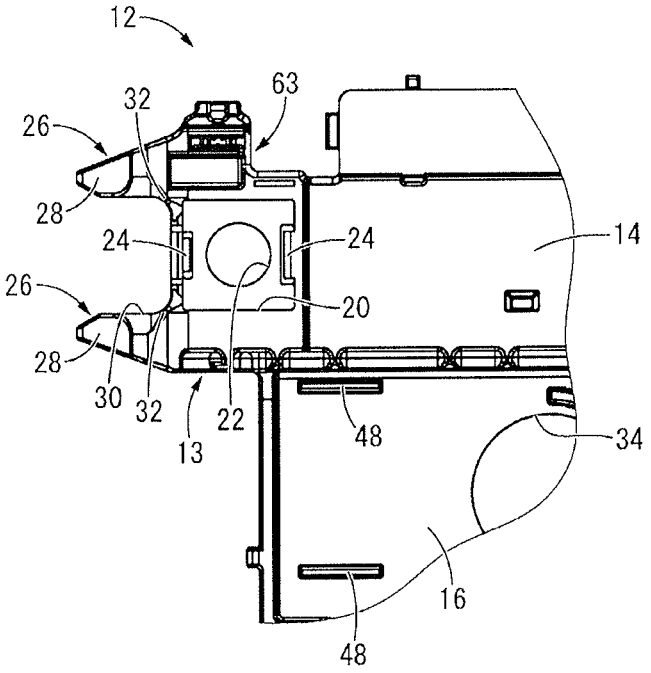
FIG. 6 is a plan view of the relevant portion of the terminal mounting portion shown in FIG. 5.
Figure 7:
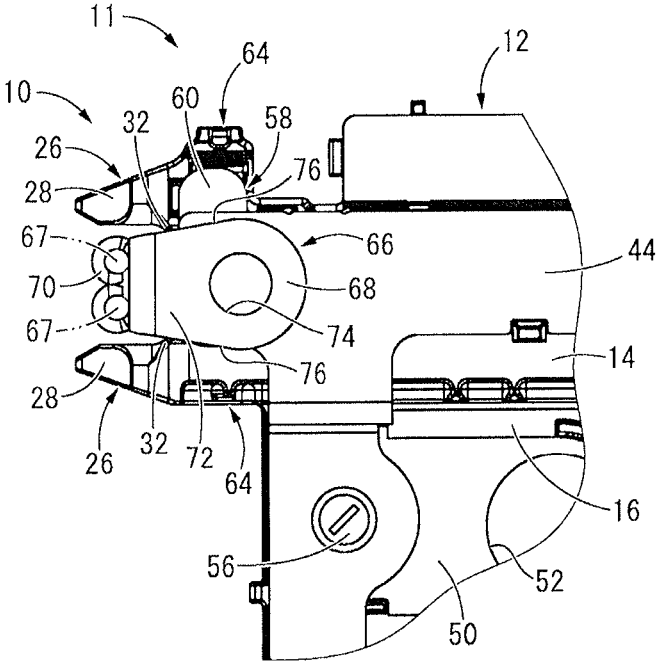
FIG. 7 is a plan view of the relevant portion of the fusible link in FIG. 1, showing that the bolt tightening terminal and the terminal mounting portion are tentatively assembled to each other before these components are fastened together with a connecting bolt.

More particularly, as shown in FIGS. 5-6, the main case body 12 is formed in a stepped shape that integrally includes an upper wall portion 14, a lower wall portion 16 extending below the upper wall portion 14, and a vertical wall portion 18 that connects the upper wall portion 14 and the lower wall portion 16.

Moreover, a terminal mounting portion 13 is provided on a corner of the main case body 12, which is formed by part of the upper wall portion 14, and a nut accommodating portion 20 is formed in the terminal mounting portion 13. The nut accommodating portion 20 is a recess that is open at the top surface thereof and has an approximately rectangular cross section, and as shown in FIG. 6, a circular fitting through hole 22 is formed in the bottom surface of the nut accommodating portion 20. Furthermore, locking lugs 24 are formed on the opening of the nut accommodating portion 20, projecting opposingly inward from a pair of opposing side wall portions of the nut accommodating portion 20. The upper surface of each locking lug 24 is formed as a guiding surface inclined downwards to its tip.

Also formed on the corner of the main case body 12 that includes the nut accommodating portion 20 is a pair of terminal rotation stopper projections 26 projecting outward in the longitudinal direction from the terminal mounting portion 13. The terminal rotation stopper projections 26 project in the longitudinal direction (to the left as seen in FIG. 6), and each terminal rotation stopper projection 26 is provided with an abutment portion 28 projecting upward for a predetermined length from the front end of the projection 26. The terminal rotation stopper projections 26 are spaced apart from each other by a predetermined distance in the width direction (the upward/downward direction as seen in FIG. 6). Formed between the terminal rotation stopper projections 26 is a terminal accommodation groove 30 that is open in the longitudinal direction and extends vertically. The walls of the terminal accommodation groove 30 are formed by the opposing surfaces of the terminal rotation stopper projections 26 and the surface of the outer surrounding wall of the nut accommodating portion 20.

Furthermore, a displacement limiting portion, such as a displacement limiting projection 32, projects from each of the terminal rotation stopper projections 26 of the terminal mounting portion 13. The displacement limiting projections 32 are integrally provided on the opposing inner surfaces of the terminal rotation stopper projections 26 so as to extend continuously in the upward/downward direction along the proximal ends of the abutment portions 28 of the terminal rotation stopper projections 26. Additionally, the front end surface of each of the displacement limiting projections 32 is formed as a smoothly curved surface that is convexed outwardly.

A battery post insertion hole 34 is formed in the lower wall portion 16. With the fusible link 11 mounted on a battery (not shown), a battery post (not shown) is adapted to be inserted through the battery post insertion hole 34 from below.

A nut 36 is disposed in the terminal mounting portion 13 of the main case body 12 thus constructed. The nut 36 includes a cylindrical portion 40 having a threaded hole 38 at the center thereof. The nut 36 further includes a flange portion 42 that projects outward from the axially central portion of the cylindrical portion 40. The flange portion 42 has peripheral surfaces shaped to conform to the nut accommodating portion 20. The nut 36 is fitted in the nut accommodating portion 20 of the terminal mounting portion 13, and as the flange portion 42 engages the inner surfaces of the side walls of the nut accommodating portion 20, the nut 36 is set in place while being prevented from rotating about its central axis with respect to the terminal mounting portion 13. Moreover, when the flange portion 42 is fitted into the nut accommodating portion 20 by pushing over the locking lugs 24, the nut 36 is prevented from coming off the nut accommodating portion 20 by means of the locking between the flange portion 42 and the locking lugs 24. As the lower portion of the cylindrical portion 40 that projects below the flange portion 42 fits into the fitting hole 22 of the nut accommodating portion 20, the nut 36 of this embodiment is positioned axially perpendicularly with respect to the terminal mounting portion 13.

As shown in FIGS. 1-3 and FIG. 7, a first bus bar 44 is attached to the main case body 12. The first bus bar 44 is a plate member can be, in some embodiments, made of a conductive material, such as iron or a copper alloy, formed in an approximate L-shape as seen from the above that extends along the outer periphery of the terminal mounting portion 13 and is set on the top surfaces of the main case body 12. Moreover, a side projection 45 projects from the L-shape corner of the first bus bar 44 to be set on the cylindrical portion 40 of the nut 36, which is disposed in the nut accommodating portion 20 of the terminal mounting portion 13. A first through hole 46 is formed in the side projection 45, aligned with the threaded hole 38 of the nut 36 on the same center axis. The part of the first bus bar 44 set on the lower wall portion 16 is supported at a position that is upwardly spaced apart from the lower wall portion 16 by a support protrusion 48 protruding from the lower wall portion 16.

Figure 4:
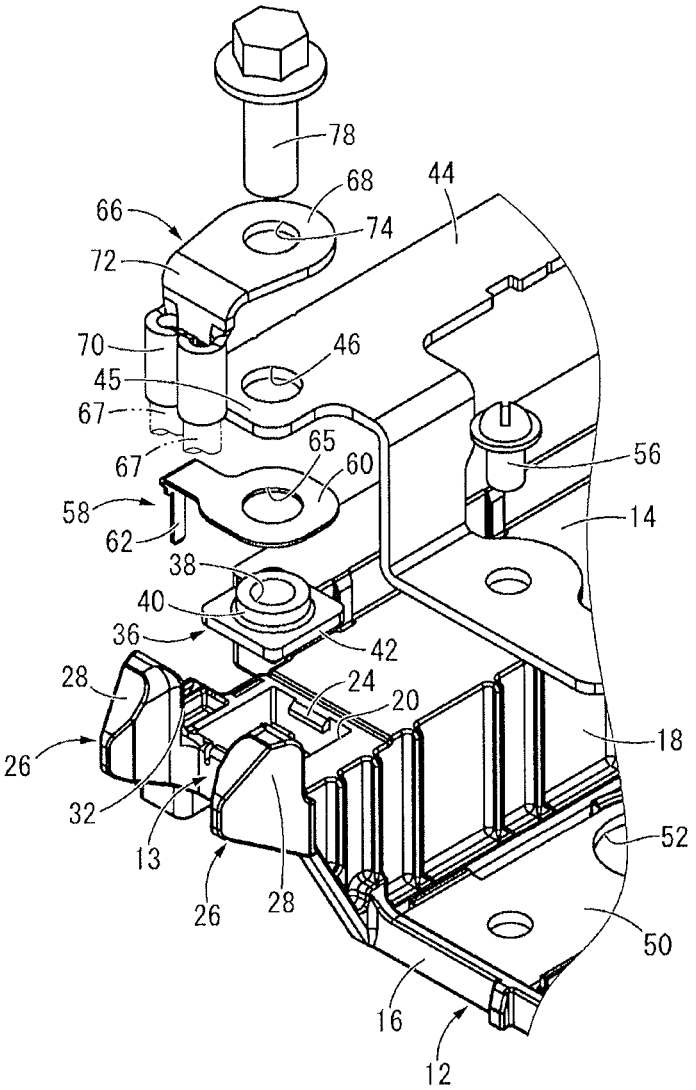
FIG. 4 is a perspective exploded view of the relevant portion of the fusible link shown in FIG. 1.

Moreover, as shown in FIG. 4, a second bus bar 50 is mounted on the terminal mounting portion 13. The second bus bar 50 is an elongated plate member can be, in some embodiments, made of the same conductive material as that of the first bus bar 44 and includes on an end thereof a conduction hole 52 into which the battery post is inserted. The circumference of the opening of the conductive hole 52 is aligned with that of the battery post insertion hole 34 of the lower wall portion 16. The other end of the second bus bar 50 is inserted between the lower wall portion 16 and the first bus bar 44 and is abutted against and coupled to the first bus bar 44 with a connection screw 56. This brings the first bus bar 44 into conduction with the battery post via the second bus bar 50.

In addition, a connector terminal 58 is disposed between the first bus bar 44 and the nut 36 as shown in FIG. 4. The connector terminal 58 integrally includes a conducting portion 60 inserted between the side projection 45 of the first bus bar 44 and the nut 36, and also includes a tab terminal portion 62 projecting downward from an end of the conducting portion 60. A connector 64 is formed with the conducting portion 60 brought into conduction with the first bus bar 44 and the tab terminal portion 62 inserted into the connector mounting portion 63 that is integrally formed on and projects from a side surface of the terminal mounting portion 13. Furthermore, a second through hole 65 is formed in the conducting portion 60 that penetrates the conducting portion 60 in the direction of the thickness thereof.

Moreover, a bolt tightening terminal 66 is mounted on the terminal mounting portion 13 of the main case body 12. The bolt tightening terminal 66 is formed, for example, of a conductive metal and electrically connected to an end of an electric wire 67. The bolt tightening terminal 66 has a connecting plate portion 68 set on the first bus bar 44 from the above, a crimp portion 70 crimped to the electric wire 67, and a link portion 72 that links the connecting plate portion 68 and the crimp portion 70. The connecting plate portion 68 has a shape of an elongated plate extending with an approximately constant thickness and includes a bolt insertion hole 74 that penetrates the connecting plate portion 68 in the direction of the thickness thereof. The crimp portion 70 includes a pair of crimps each having an approximately cylindrical shape and extends vertically in a cross-section of a general shape of an eyeglass frame. The crimp portion 70 is attached to an end of the electrical wire 67 by inserting the terminal of the electric wire 67 into the crimps and compressing the crimps. The link portion 72 has a plate shape bent in an intermediate section and is integrally formed with the connecting plate portion 68 and the crimp portion 70 so that the connecting plate portion 68 and the crimp portion 70 extend perpendicularly to each other.

Figure 8A:
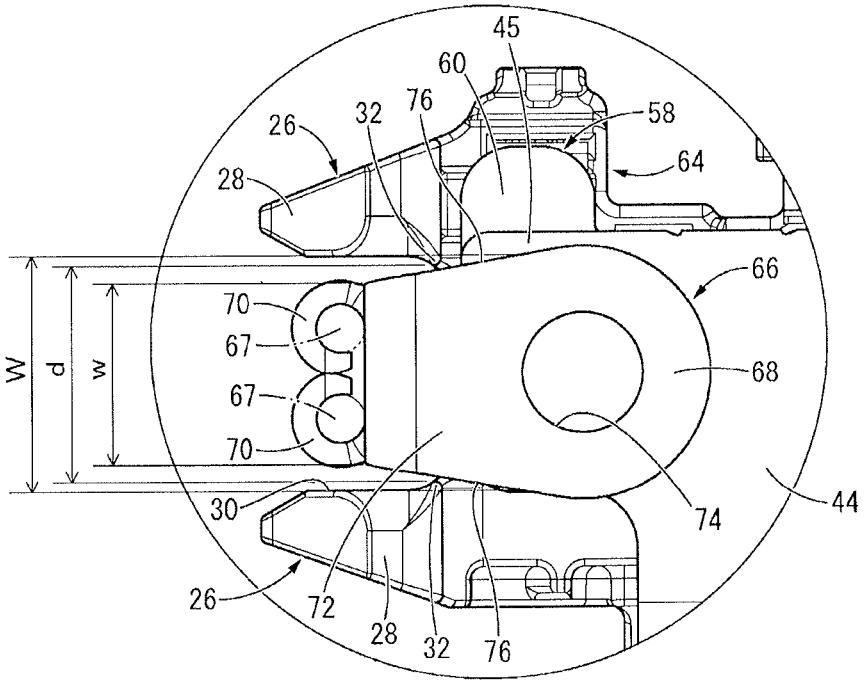
FIGS. 8A-8B illustrate an enlarged plan view of the relevant portions of the fusible link in FIG. 7 with FIG. 8A showing the bolt tightening terminal disposed in the proper mounting position and FIG. 8B showing the bolt tightening terminal displaced from the proper mounting position.

Moreover, as shown in FIG. 8A, in the bolt tightening terminal 66, both widthwise side surfaces of the part of the link portion 72 facing the connecting plate portion 68 are formed as tapered surfaces 76 extending obliquely in widthwise directions such that the width dimension of the part of the link portion 72 facing the connecting plate portion 68 (W) is made larger than the width dimension of the part of the link portion 72 facing the crimp portion 70 (w). In this embodiment, the part of the connecting plate portion 68 facing the link portion 72 is made gradually wider than the link portion 72 as it is farther away from the link portion 72. Furthermore, the distance of separation between the pair of displacement limiting projections 32 (d) is smaller than the width dimension of the part of the link portion 72 facing the connecting plate portion 68 and is made larger than the width dimension of the part of the link portion 72 facing the crimp portion 70. Additionally, the part of the outer peripheral surface of the connecting plate portion 68 opposite to the link portion 72 is formed into an approximately semicircular cylindrical surface having a largest width dimension where the bolt insertion hole 74 is formed.

The bolt tightening terminal 66 is fastened to the terminal mounting portion 13 by placing the connecting plate portion 68 on the top surface of the terminal mounting portion 13 and tightening a connecting bolt 78 in the threaded hole 38 of the nut 36 after the connecting bolt 78 is passed through the bolt insertion hole 74. Furthermore, the link portion 72 of the bolt tightening terminal 66 is interposed between the terminal rotation stopper projections 26 (in the terminal accommodation groove 30) so that, when the connecting bolt 78 is tightened to the nut 36, the rotation of the bolt tightening terminal 66 is limited by abutment between the link portion 72 and the terminal rotation stopper projections 26, located on both sides of the link portion 72.

Moreover, as the bolt tightening terminal 66 is disposed in the proper mounting position in which the bolt insertion hole 74 and the threaded hole 38 are aligned with each other on the same center axis, the part of the link portion 72 facing the crimp portion 70, i.e., the narrower part of the link portion 72, is interposed between the displacement limiting projections 32 from the above. As described above, as the distance of separation between the displacement limiting projections 32 is made larger than the width dimension of the part of the link portion 72 facing the crimp portion 70, the displacement limiting projections 32 are located on both widthwise sides of the link portion 72 with sufficient clearances to avoid interference of the link portion 72 with the displacement limiting projections 32.

Moreover, as the distance of separation between the displacement limiting projections 32 is made smaller than the width dimension of the part of the link portion 72 facing the connecting plate portion 68, i.e., the wider part of the link portion 72, this part of the link portion 72 and the displacement limiting projections 32 overlap each other for a predetermined width dimension as seen in a longitudinal projection.

Figure 8B:
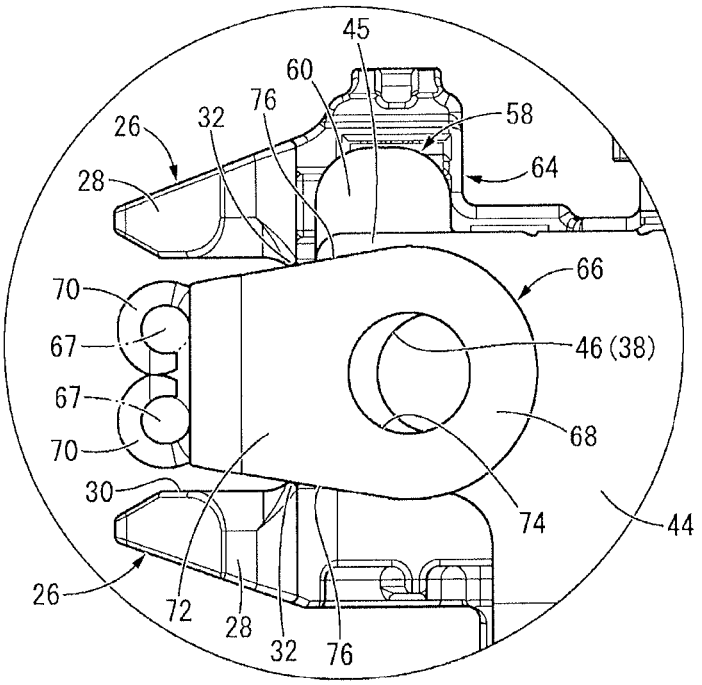

Additionally, as shown in FIG. 8B, the amount of displacement of the bolt tightening terminal 66 relative to the terminal mounting portion 13 is limited as the link portion 72 is brought into abutment against and interferes with the displacement limiting projections 32. More particularly, if the bolt tightening terminal 66, disposed in the proper mounting position with respect to the terminal mounting portion 13 (as shown in FIG. 8A), is displaced longitudinally toward the crimp portion 70 with respect to the terminal mounting portion 13, the part of the link portion 72 facing the connecting plate portion 68 and the displacement limiting projections 32, which overlap with each other in the longitudinal direction, abut and interfere with each other (as shown in FIG. 8B). In this way, the displacement of the bolt tightening terminal 66 from the proper mounting position is limited due to interference between the part of the link portion 72 facing the connecting plate portion 68 and the displacement limiting projections 32.

In this way, in the terminal connection structure 10 provided in the fusible link 11 according to this embodiment, the relative displacement between the bolt tightening terminal 66 and the terminal mounting portion 13 is limited when the bolt tightening terminal 66 and the terminal mounting portion 13 are tentatively assembled to each other before these components are fastened together with the connecting bolt 78. This advantageously prevents the bolt tightening terminal 66 from being displaced from or dropping off the terminal mounting portion 13. In particular, this embodiment prevents displacement or drop-off of the bolt tightening terminal 66 especially in structures in which a nut 36, rather than a stud bolt, is employed on the terminal mounting portion 13, so that it is difficult to align the bolt tightening terminal 66 with the terminal mounting portion 13 when these components are tentatively assembled.

FIG. 8 shows an example in which the bolt tightening terminal 66 is slidingly displaced in the longitudinal direction with respect to the terminal mounting portion 13. Additionally, for example, in the case where the connecting plate portion 68 is rotatably displaced about an axis that extends in the width direction, the rotatable displacement can also be limited by the displacement limiting means realized by the abutment between the connecting plate portion 68 and the displacement limiting projections 32. The bolt tightening terminal 66 is susceptible to such rotational displacement as described above since most of the weight of the electric wire 67 is applied to the part of the bolt tightening terminal 66 facing the crimp portion 70. However, the bolt tightening terminal 66 is prevented from dropping off the terminal mounting terminal 13 as the connecting plate portion 68 is brought into abutment against and caught on the displacement limiting projections 32.

In addition, as the displacement limiting projections 32 come into abutment against both of the widthwise sides of the bolt tightening terminal 66, upon such abutment, the bolt tightening terminal 66 avoids being tilted by reaction force, thus being stably held in a predetermined state of tentative assembly in which the connecting plate portion 68 is set on the terminal mounting portion 13. Furthermore, as the link portion 72 of the bolt tightening terminal 66, which comes into abutment with the displacement limiting projections 32, has a tapered shape whose width dimension gradually changes in the longitudinal direction, no cutouts or other structures for engaging the displacement limiting projections 32 need to be provided in the link portion 72. This simplifies the shape of the part of the link portion 72 facing the connecting plate portion 68, which in turn facilitates its manufacturing and also prevents the cross section of the link portion 72 from being partially reduced, thus providing advantageous electrical properties.

Moreover, in this embodiment, the crimp portion 70 of the bolt tightening terminal 66 is disposed on the outer peripheral surface of the terminal mounting portion 13 (the bottom surface of the terminal accommodation groove 30). The abutment between the crimp portion 70 and the terminal mounting portion 13 limits the longitudinal displacement of the bolt tightening terminal 66 relative to the terminal mounting portion 13 towards the other end of the terminal mounting portion 13.

While being held in a state of tentative assembly to the terminal mounting portion 13 as described above, the bolt tightening terminal 66 is adapted to be fastened to the terminal mounting portion 13 by tightening the connecting bolt 78 in the threaded hole 38 of the nut 36 after the bolt 78 is passed through the bolt insertion hole 74, the first through hole 46, and the second through hole 65. In this embodiment, the displacement of the bolt tightening terminal 66 relative to the terminal mounting portion 13 is limited when the terminal 66 is tentatively assembled to the terminal mounting portion 13. This maintains the threaded hole 38 of the nut 36 in communication with the bolt insertion hole 74 of the bolt tightening terminal 66 to facilitate tightening of the connecting bolt 78 into the threaded hole 38. Moreover, the connecting bolt 78 fastens both of the first bus bar 44 and the connector terminal 58 to the terminal mounting portion 13, and the bolt tightening terminal 66 and the connector terminal 58 are held in conduction by being in contact with the first bus bar 44.

Having described an embodiment of the present application, other embodiments of the present application are not limited to the specific description of the embodiment. For example, the interference between the link portion of the bolt tightening terminal and the displacement limiting portions may not necessarily be realized by the tapered shape of the link portion as in the foregoing embodiment. Instead, cutouts may be formed in the side surfaces of the link portion to receive the displacement limiting portions therein such that the displacement limiting portions engage and interfere with the inner surfaces of the cutouts if the bolt tightening terminal is displaced from the proper mounting position. As a further example, the link portion may also be formed in a stepped shape whose width dimension changes in a stepwise manner at the step to allow the displacement limiting portions to abut against and interfere with the step.

Furthermore, the shape of the bolt tightening terminal should not be interpreted as being limited to the one described in the foregoing embodiment. Although the bolt tightening terminal of the foregoing embodiment is an L-shaped terminal with a bent link portion, the link portion may be, for example, linearly extended rather than bent so as to locate the connecting plate portion and the crimp portion approximately in the same plane. Moreover, the bolt tightening terminal is not limited to the type that causes the link portion to interfere with the displacement limiting portion when the terminal is displaced from its proper mounting position. For example, the bolt tightening terminal may also be configured to cause the connecting plate portion or the crimp portion to interfere with the displacement limiting portion when the terminal is displaced from its proper mounting position.

Moreover, the displacement limiting projections may be formed separately from the terminal rotation stopper projections, and the terminal rotation stopper projections may not be essential to embodiments of the present application. Furthermore, the displacement limiting projections, if integrally formed with the terminal rotation stopper projections, do not have to be formed on the proximal ends of the terminal rotation stopper projections. For example, the displacement limiting projections may also be formed on the entire opposing inner surfaces of the pair of the terminal rotation stopper projections. Moreover, various structures of the embodiment, such as the nut, the bus bars, the connector terminal, the main case body, which includes the terminal mounting portion, etc., may be modified as required.

Moreover, in the foregoing embodiment, a pair of displacement limiting projections are employed as examples of the displacement limiting portions. However, the displacement limiting portions are not limited to any specific structure. For example, the displacement limiting portions may be constituted by one or at least three projections that come into abutment against and interfere with the bolt tightening terminal if the bolt tightening terminal is displaced from the proper mounting position.

In the foregoing embodiment, a fusible link is employed as an exemplary electrical circuit. The terminal connection structure according to embodiments of the present application can also be advantageously applied to various types of electrical connection boxes.

Further, although specific embodiments have been illustrated and described herein, those of ordinary skill in the art appreciate that any arrangement which is calculated to achieve the same purpose may be substituted for the specific embodiments shown and that embodiments of the invention have other applications in other environments. The present application is intended to cover any adaptations or variations of the present inventions. The following claims are in no way intended to limit the scope of embodiments of the invention to the specific embodiments described herein.

LIST OF REFERENCE NUMERALS

10 terminal connection structure
11 fusible link (electrical circuit)
13 terminal mounting portion
26 terminal rotation stopper projection
32 displacement limiting projection (displacement limiting portion)
36 nut

38 threaded hole
66 bolt tightening terminal
68 connecting plate portion
70 crimp portion
72 link portion
74 bolt insertion hole
75 electrical wire
78 connecting bolt

The invention claimed is:

1. A terminal connection structure comprising:

a terminal mounting portion provided on an electric circuit;

a nut with a threaded hole formed therein and that is disposed on the terminal mounting portion;

a bolt tightening terminal with a bolt insertion hole formed therein and that is provided at an electrical wire end; and a connection bolt, wherein the bolt tightening terminal is set on the terminal mounting portion and is fastened to the terminal mounting portion by passing the connection bolt through the bolt insertion hole of the bolt tightening terminal and tightening the connection bolt to the threaded hole of the nut;

wherein the terminal mounting portion is provided with a displacement limiting portions, wherein a dimension of separation between a pair of displacement limit projections constituting said displacement limiting portion is smaller than a width dimension of a part of a link portion facing a connection plate portion of the bolt tightening terminal;

wherein the bolt tightening terminal is configured such that, if the bolt tightening terminal, set on the terminal mounting portion, is disposed in a proper mounting position in which the bolt insertion hole and the threaded hole are aligned with each other on a same center axis, the bolt tightening terminal does not interfere with the displacement limiting portion; and wherein the bolt tightening terminal is configured such that, when the bolt tightening terminal, set on the terminal mounting portion, is displaced from a proper mounting position, the bolt tightening terminal interferes with the displacement limiting portion, limiting a displacement of the bolt tightening terminal from the proper mounting position.

2. The terminal connection structure according to claim 1, wherein the bolt tightening terminal includes a connecting plate portion having the bolt insertion hole provided therein, the connecting plate portion being set on the terminal mounting portion, a crimp portion crimped to the electrical wire end, and a link portion that links the connecting plate portion and the crimp portion, and a width dimension of a part of the link portion facing the connecting plate portion is made larger than a width dimension of a part of the link portion facing the crimp portion, and wherein the terminal mounting portion includes a pair of displacement limiting projections located on both widthwise sides of the link portion, and a dimension of separation between the pair of displacement limiting projections is larger than the width dimension of the part of the link portion facing the crimp portion.

3. The terminal connection structure according to claim 2, wherein the terminal mounting portion is provided with a pair of terminal rotation stopper projections on both widthwise sides of the link portion, and the pair of displacement limiting projections is integrally provided on opposing inner surfaces of the pair of terminal rotation stopper projections.

4. The terminal connection structure according to claim 2, wherein each of the terminal rotation stopper projections is provided with an abutment portion projecting upward for a predetermined length from a front end of each of the terminal rotation stopper projections.

5. The terminal connection structure according to claim 4, wherein the pair of terminal rotation stopper projections are spaced apart from each other by a predetermined distance in a width direction.

6. The terminal connection structure according to claim 2, wherein formed between the terminal rotation stopper projections is a terminal accommodation groove that is open in the longitudinal direction and extends vertically.

7. The terminal connection structure according to claim 6, wherein walls of the terminal accommodation groove are formed by opposing surfaces of the terminal rotation stopper projections and a surface of an outer surrounding wall of a nut accommodating portion.

8. The terminal connection structure according to claim 2, wherein a front end surface of each of the displacement limiting projections is formed as a curved surface that is outwardly convexed.

9. A terminal connection structure comprising:

a terminal mounting portion provided on an electric circuit;

a nut with a threaded hole formed therein and that is disposed on the terminal mounting portion;

a bolt tightening terminal with a bolt insertion hole formed therein and that is provided at an electrical wire end; and a connection bolt, wherein the bolt tightening terminal is set on the terminal mounting portion and is fastened to the terminal mounting portion by passing the connection bolt through the bolt insertion hole of the bolt tightening terminal and tightening the connection bolt to the threaded hole of the nut; and wherein the terminal mounting portion is provided with a displacement limiting portion, wherein a dimension of separation between a pair of displacement limit projections constituting said displacement limiting portions is smaller than a width dimension of a part of a link portion facing a connection plate portion of the bolt tightening terminal, and wherein the displacement limit portion limits a displacement of the bolt tightening terminal from a proper mounting position based on interferences with the bolt tightening terminal.

* * * * *